US009664149B2

(12) United States Patent
Seo et al.

(10) Patent No.: US 9,664,149 B2
(45) Date of Patent: May 30, 2017

(54) INSERT TYPE EXPANSION PIPE-INTEGRATED AIR CLEANER AND ENGINE INTAKE SYSTEM THEREFOR

(71) Applicants: Hyundai Motor Company, Seoul (KR); Kia Motors Corporation, Seoul (KR)

(72) Inventors: Yong-Gyo Seo, Suwon-si (KR); Seong-Youn Kwak, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 146 days.

(21) Appl. No.: 14/550,004

(22) Filed: Nov. 21, 2014

(65) Prior Publication Data

US 2016/0032875 A1 Feb. 4, 2016

(30) Foreign Application Priority Data

Jul. 29, 2014 (KR) ..... 10-2014-0096374

(51) Int. Cl.
*F02M 35/02* (2006.01)
*F02M 35/10* (2006.01)
(Continued)

(52) U.S. Cl.
CPC ..... *F02M 35/0204* (2013.01); *F02M 35/10* (2013.01); *F02M 35/02416* (2013.01);
(Continued)

(58) Field of Classification Search
CPC ..... F02M 35/024; F02M 35/02491; F02M 35/0204; F02M 35/048; F02M 35/10;
(Continued)

(56) References Cited

U.S. PATENT DOCUMENTS 5,865,863 A * 2/1999 DeSousa ..... F02M 35/0203 123/198 E
6,098,586 A * 8/2000 Bloomer ..... F02M 35/10039 123/184.21
(Continued)

FOREIGN PATENT DOCUMENTS

JP 10-331732 A 12/1998
JP 2002-266715 A 9/2002
(Continued)

*Primary Examiner* — Stephen K Cronin
*Assistant Examiner* — Long T Tran
(74) *Attorney, Agent, or Firm* — Morgan Lewis & Bockius LLP

(57) ABSTRACT

An insert type expansion pipe-integrated air cleaner may include an air cleaner body having a filter chamber in which air is introduced from an outside, the filter chamber having a chamber space provided with a filter, the chamber space being covered by an air cleaner cover, an expansion pipe chamber connected to the filter chamber such that the introduced air is discharged from the expansion pipe chamber to the outside, and a female passage boss through which the introduced air passes from the filter chamber to the expansion pipe chamber by having a cross-sectional area smaller than a cross-sectional area of the expansion pipe chamber while the female passage boss divides the filter chamber and the expansion pipe chamber.

9 Claims, 11 Drawing Sheets

CROSS-SECTION A-A

(51) Int. Cl.
*F02M 35/12* (2006.01)
*F02M 35/024* (2006.01)
*F02M 35/04* (2006.01)

(52) U.S. Cl.
CPC ..... *F02M 35/02491* (2013.01); *F02M 35/044* (2013.01); *F02M 35/1272* (2013.01)

(58) Field of Classification Search
CPC .... F02M 35/14; F02M 35/0203; F02M 35/02; F02M 35/0201; F02M 35/0207
USPC ..... 123/184.21, 198 E
See application file for complete search history.

(56) References Cited

U.S. PATENT DOCUMENTS 6,251,151 B1 * 6/2001 Kobayashi ..... F02B 61/02 123/198 E
6,530,984 B2 * 3/2003 Stuart ..... F02M 35/02 123/184.57
6,783,579 B2 * 8/2004 Pettipiece ..... B01D 46/10 123/184.57
8,562,726 B2 * 10/2013 Jun ..... F02M 35/02491 123/198 E
2008/0053394 A1 * 3/2008 Tsutsui ..... F02M 35/10295 123/184.21
2009/0178879 A1 * 7/2009 Park ..... B01D 46/10 181/224
2012/0204846 A1 * 8/2012 Schultz ..... F02M 25/06 123/573

FOREIGN PATENT DOCUMENTS

JP 3956611 B2 5/2007
JP 2008-223498 A 9/2008
KR 10-1997-0001889 A 1/1997
KR 10-0251175 B1 1/2000
KR 10-0362718 B1 11/2002
KR 10-1393759 B1 5/2014

* cited by examiner

CROSS-SECTION A-A

<EQUATION OF BODY B EXPANSION PIPE>

$$TL=10Log_{10}\left[1+0.25\times\left(\frac{A2}{A1}-\frac{A2}{A1}\right)^2\times\sin^2\left(\frac{2\pi Lf}{c}\right)\right]$$

PERFORMANCE CHART

ETC: Electromic Throttle Control

INSERT TYPE EXPANSION PIPE-INTEGRATED AIR CLEANER AND ENGINE INTAKE SYSTEM THEREFOR

CROSS-REFERENCE TO RELATED APPLICATIONS

The present application claims priority to Korean Patent Application No. 10-2014-0096374, filed Jul. 29, 2014, the entire contents of which is incorporated herein for all purposes by this reference.

BACKGROUND OF THE INVENTION

Field of the Invention

Various embodiments of the present invention relate to an air cleaner, and, particularly, to an insert type expansion pipe-integrated air cleaner and an engine intake system therefor in which an improvement in pressure absorption performance, a reduction in ventilation resistance, and an improvement in Noise, Vibration, and Harshness (NVH) of the intake system are achieved by formation of an expansion pipe using an air cleaner cover and an air cleaner body of an insert type coupling structure.

Description of Related Art

An engine intake system is generally composed of an air cleaner. The air cleaner filters out foreign matters such as dust contained in air introduced from the outside such that clean intake air may be supplied to an engine.

Air cleaners may be largely classified into an engine cover-integrated air cleaner, a drawer type air cleaner, a bolt type air cleaner, etc.

The engine cover-integrated air cleaner is composed of an air cleaner cover connected to an engine cover, an air cleaner body, a resonator, a filter, and two clamps. The drawer type air cleaner is composed of an air cleaner cover, an air cleaner body, a filter, an air cleaner cap, two clamps for fixing the air cleaner body and the air cleaner cap, and a cam-shaft rod for fixing filters. The bolt type air cleaner is composed of an air cleaner cover, an air cleaner body, a filter, and six bolts.

However, the engine cover-integrated air cleaner has limits in terms of high costs required to manufacture an air cleaner mold due to a hinge insertion structure, low capacity of the air cleaner caused by integration of the resonator with the air cleaner body, poor maintenance of the air cleaner requiring separation of the air cleaner cover, etc.

In addition, the drawer type air cleaner has limits in terms of increases in additional components and costs due to a drawer mounting structure, addition of a hinge structure of the air cleaner body and the air cleaner cap due to the clamps, addition of a bonding structure of the air cleaner cap, the cam-shaft rod, and the air cleaner body due to the cam-shaft rod for fixing filters, an increase in pressure bring about a reduction in engine 2 HP/pressure absorption 1 Kpa by a filtration area reduction of the filter due to the drawer mounting structure, etc.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an insert type expansion pipe-integrated air cleaner and an engine intake system therefor in which an improvement in pressure absorption performance, a reduction in ventilation resistance, reductions in the number of components and fastening processes, an improvement in high-frequency noise, an improvement in pressure absorption of the intake system, and an improvement in Noise, Vibration, and Harshness (NVH) may be achieved, compared to an engine cover-integrated air cleaner, a drawer type air cleaner, and a bolt type air cleaner.

According to various aspects of the present invention, an insert type expansion pipe-integrated air cleaner includes an air cleaner body including a filter chamber in which air is introduced from an outside, the filter chamber having a chamber space provided with a filter, the chamber space being covered by an air cleaner cover, an expansion pipe chamber connected to the filter chamber such that the introduced air is discharged from the expansion pipe chamber to the outside, and a female passage boss through which the introduced air passes from the filter chamber to the expansion pipe chamber by having a cross-sectional area smaller than a cross-sectional area of the expansion pipe chamber while the female passage boss divides the filter chamber and the expansion pipe chamber.

The filter chamber may be formed with an air inlet through which the air is introduced, the expansion pipe chamber may be formed with an air outlet through which the air is discharged, and the air outlet may be formed at a portion of the expansion pipe chamber deviated from the filter chamber.

The air cleaner cover may be formed with a male passage boss protruding from the air cleaner cover such that the male passage boss is inserted into the female passage boss, and a sealing ring may be fitted to the female passage boss.

The air cleaner cover may further include fixtures protruding to a peripheral portion of the male passage boss, and the fixtures may be fixedly fitted to a peripheral portion of the female passage boss.

The female passage boss may include first and second female passage bosses distinguished from each other, the male passage boss may include first and second male passage bosses distinguished from each other, and the fixtures may include a first fixture fitted to a groove at an intermediate portion at which the first female passage boss comes into contact with the second female passage boss, a second fixture fitted to a groove at a left portion of the first male passage boss, and a third fixture fitted to a groove at a right portion of the second male passage boss.

Each of the first and second female passage bosses and the first and second male passage bosses may form an oval air passage hole.

The expansion pipe chamber may be provided with a compression/sound absorption duct for reducing discharge noise due to a flow of the air discharged to the outside, and the compression/sound absorption duct may protrude from a bottom surface of the expansion pipe chamber.

The insert type expansion pipe-integrated air cleaner may further include a hook coupling a portion of the air cleaner cover, which is not coupled to the female passage boss, to a portion of the filter chamber, and the hook may act as a hinge point of the air cleaner cover when the air cleaner cover is separated from the female passage boss.

The hook may include a hinge strap formed at a portion of the filter chamber and a hinge boss formed at the portion of the air cleaner cover.

The expansion pipe chamber may be coupled to an air cleaner cap, and the air cleaner cap may block a chamber space in the expansion pipe chamber from the outside, the introduced air being discharged from the chamber space to the outside.

According to various aspects of the present invention, an engine intake system includes an air cleaner having an air cleaner body including a filter chamber in which air is introduced from an outside, the filter chamber having a chamber space provided with a filter, the chamber space being covered by an air cleaner cover, an expansion pipe chamber connected to the filter chamber such that introduced air is discharged from the expansion pipe chamber to the outside, and a female passage boss through which the introduced air passes from the filter chamber to the expansion pipe chamber by having a cross-sectional area smaller than a cross-sectional area of the expansion pipe chamber while the female passage boss divides the filter chamber and the expansion pipe chamber, a compression/sound absorption duct protruding from a bottom surface of the expansion pipe chamber to reduce discharge noise due to a flow of air discharged to the outside, a fixture protruding to a peripheral portion of a male passage boss such that the air cleaner cover is fixedly fitted to a peripheral portion of the female passage boss, a sealing ring fitted to the female passage boss to maintain sealing between the air cleaner cover and the filter chamber, and a hook coupling a portion of the air cleaner cover, which is not coupled to the female passage boss, to a portion of the filter chamber and acting as a hinge point of the air cleaner cover when the air cleaner cover is separated from the female passage boss, and an engine cover coupled to the expansion pipe chamber.

The engine cover may block an inner space of the expansion pipe chamber from the outside.

The filter chamber may be connected to an intake duct provided in an engine room for introducing air from the outside. The expansion pipe chamber may be connected to an intake hose, and the intake hose may be connected to an Electronic Throttle Control (ETC) for controlling intake air supplied to the engine.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1A:
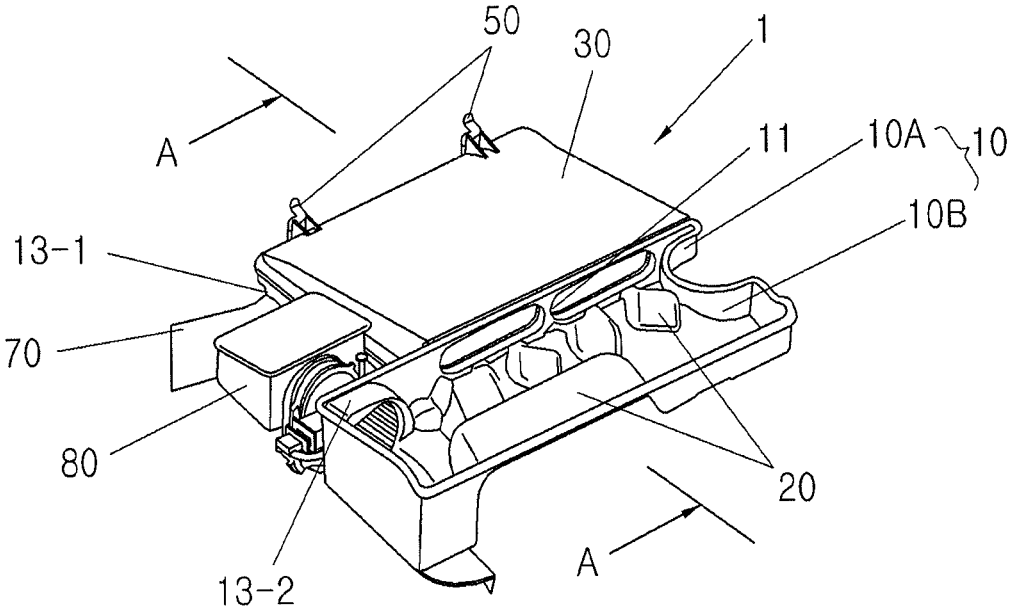
FIG. 1A and FIG. 1B are views illustrating a configuration of an exemplary insert type expansion pipe-integrated air cleaner according to the present invention.
Figure 1B:
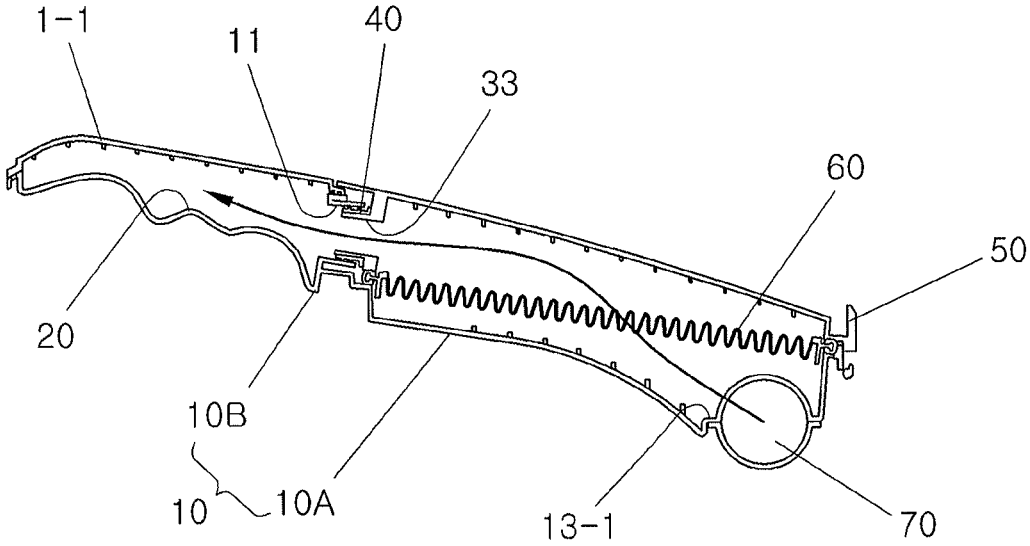
Figure 2A:
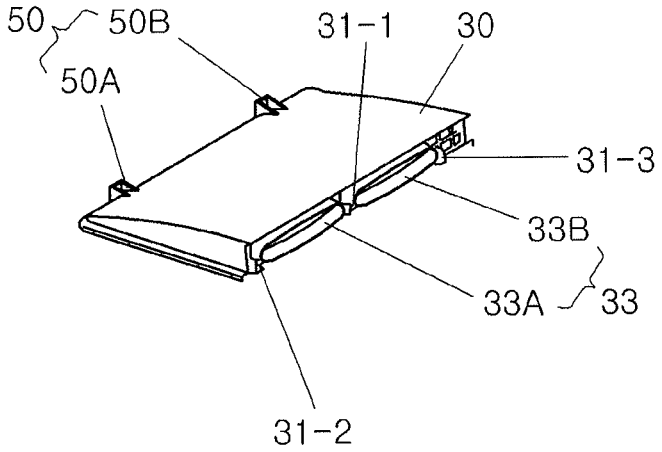
FIG. 2A, FIG. 2B, FIG. 2C, and FIG. 2D are exploded views illustrating the configuration of the exemplary insert type expansion pipe-integrated air cleaner according to the present invention.
Figure 2B:
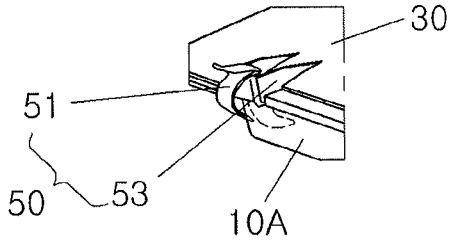
Figure 2C:
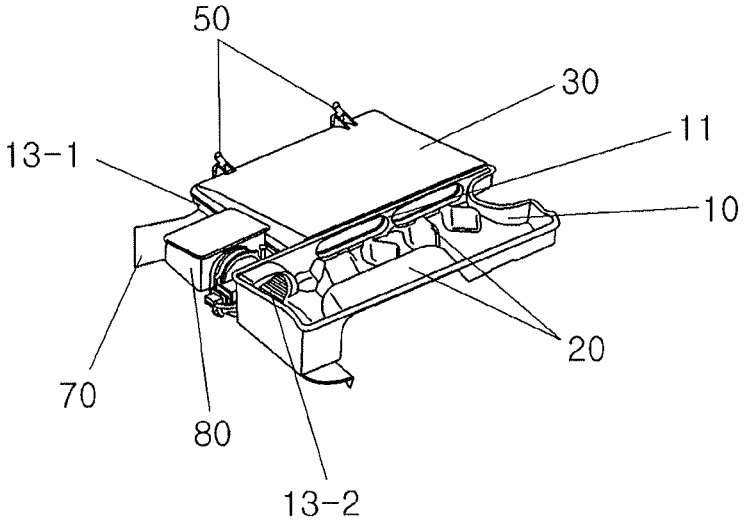
Figure 2D:
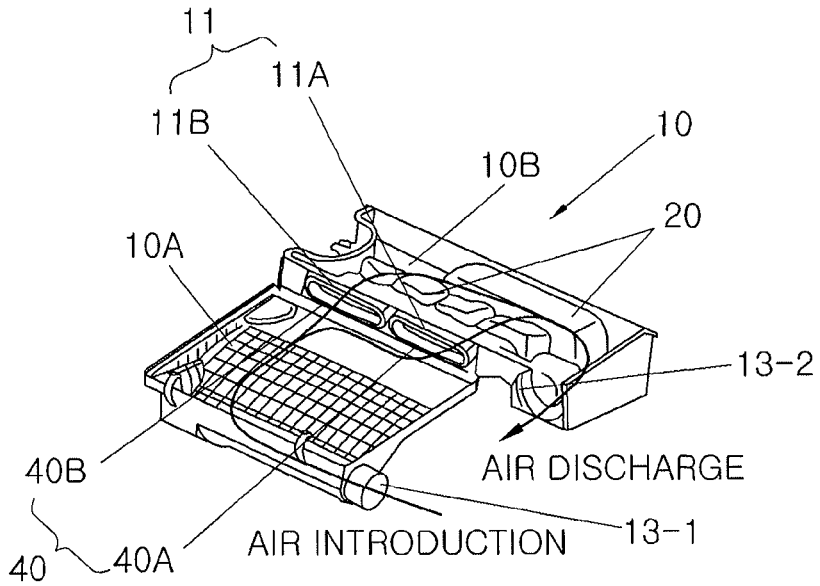

FIG. 1A and FIG. 1B are views illustrating a configuration of an insert type expansion pipe-integrated air cleaner according to various embodiments of the present invention.

As shown in the drawing, an insert type expansion pipe-integrated air cleaner 1 includes an air cleaner cap 1-1, an air cleaner body 10, compression/sound absorption ducts 20, an air cleaner cover 30, a hook 50, a filter 60, an intake duct 70, and an intake hose 80.

The air cleaner cap 1-1 covers a partial exposure space of the air cleaner body 10 to block the space from the outside. The air cleaner cap 1-1 may be a separate cover plate, but means an engine cover due to characteristics of the air cleaner 1 installed in an engine.

The air cleaner body 10 is divided into a filter chamber 10A covered by the air cleaner cover 30 and an expansion pipe chamber 10B covered by the air cleaner cap 1-1. An air inlet 13-1 is formed at one side of the filter chamber 10A so that air is introduced into the filter chamber 10A from the outside through the air inlet 13-1. An air outlet 13-2 is formed at one side of the expansion pipe chamber 10B such that air is discharged from the expansion pipe chamber 10B to the outside through the air outlet 13-2. Therefore, as in cross-section A-A, an air flow path is defined in which the air introduced through the air inlet 13-1 is discharged through the air outlet 13-2 via the filter chamber 10A and the expansion pipe chamber 10B.

The compression/sound absorption ducts 20 reduce discharge noise of air discharged through the air outlet 13-2 via the expansion pipe chamber 10B by slightly suppressing the flow of air passing through the expansion pipe chamber 10B of the air cleaner body 10. The compression/sound absorption ducts 20 are bonded to a bottom surface of the expansion pipe chamber 10B.

The air cleaner cover 30 is connected to a female passage boss 11 dividing the filter chamber 10A and expansion pipe chamber 10B of the air cleaner body 10, and thus may be fixed in such a manner that one end portion of the air cleaner cover 30 is inserted into the female passage boss 11. The air cleaner cover 30 is coupled to the filter chamber 10A of the air cleaner body 10 such that a chamber space of the filter chamber 10A may be blocked from the outside.

The hook 50 couples the air cleaner body 10 and the air cleaner cover 30 by a hinge, and thus the air cleaner cover 30 may move about the hook 50 as a hinge point when the air cleaner cover 30 is separated from the air cleaner body 10.

The filter 60 is provided in the chamber space of the filter chamber 10A of the air cleaner body 10 and is fixed by the air cleaner cover 30 so as not to move. The filter 60 filters out foreign matters contained in the air which is introduced into the chamber space of the filter chamber 10A and then discharged to the expansion pipe chamber 10B.

The intake duct 70 has a bellows inserted thereto and acts as a passage through which outdoor air is introduced. Therefore, the intake duct 70 is connected to the air inlet 13-1 of the air cleaner body 10. The intake duct 70 means an air intake duct due to characteristics of the air cleaner 1 constituting the engine intake system.

The intake hose 80 acts as a passage through which air in the air cleaner body 10 is discharged to the outside. Therefore, the intake hose 80 is connected to the air outlet 13-2 of the air cleaner body 10. The intake hose 80 means an Electronic Throttle Control (ETC) connection hose connected to an ETC due to characteristics of the air cleaner 1 constituting the engine intake system.

FIG. 2A, FIG. 2B, FIG. 2C and FIG. 2D show a detailed coupling structure of the air cleaner body 10, the air cleaner cover 30, a sealing ring 40, and the hook 50.

As shown in the drawing, the air cleaner body 10 includes the filter chamber 10A having a lattice formed on a bottom surface thereof, the expansion pipe chamber 10B in which a plurality of compression/sound absorption ducts 20 are bonded to the bottom surface at intervals, the female passage boss 11 having a structure of protruding toward the filter chamber 10A such that the sealing ring 40 is fitted to the female passage boss 11, the air inlet 13-1, and the air outlet 13-2.

In particular, a hinge strap 51 forming the hook 50 is formed at one end portion of the filter chamber 10A and the hinge strap 51 is located at an opposite portion of the female passage boss 11. Consequently, the hinge strap 51 functions such that the air cleaner cover 30 moves about the hook 50 as a hinge point when the air cleaner cover 30 is separated from the filter chamber 10A. In addition, the expansion pipe chamber 10B has a relatively long width compared to the filter chamber 10A such that the air outlet 13-2 is formed at one end portion of the expansion pipe chamber 10B. Therefore, the intake duct 70 connected to the filter chamber 10A using the air inlet 13-1 and the intake hose 80 connected to the expansion pipe chamber 10B using the air outlet 13-2 may have a layout degree of freedom with no interference due to corresponding parts. In addition, the female passage boss 11 is divided into a first female passage boss 11A and a second female passage boss 11B forming oval air passages. Therefore, the sealing ring 40 is divided into a first sealing ring 40A fitted to the first female passage boss 11A and a second sealing ring 40B fitted to the second female passage boss 11B.

According to the structure of the air cleaner body 10, performance improvements such as an improvement in pressure absorption performance, a reduction in ventilation resistance, and an improvement in high-frequency noise may be effectively achieved in the introduction and discharge process of air. In addition, structural improvements such as reductions in the number of components and fastening processes and an improvement in maintenance may be achieved. Particularly, the expansion pipe chamber 10B may act as a surge tank such that the flow of air discharged from the filter chamber 10A is stabilized by flow reduction of the air and NVH is improved by wavelength reduction of the engine.

The air cleaner cover 30 is formed with a male passage boss 33 to which the female passage boss 11 of the air cleaner body 10 is fitted, and a hinge boss 53 forming the hook 50 is formed opposite the male passage boss 33. Therefore, the hinge boss 53 functions such that the air cleaner cover 30 moves about the hook 50 as a hinge point when the air cleaner cover 30 is separated from the filter chamber 10A. Particularly, first, second, third fixtures 31-1, 31-2, and 31-3 are further formed between the first and second male passage bosses 33A and 33B.

In addition, the hook 50 is configured of the hinge strap 51 formed at the filter chamber 10A of the air cleaner body 10 and the hinge boss 53 formed at the air cleaner cover 30. Particularly, the hook 50 is configured of a pair of first and second hooks 50A and 50B and thus may provide a more stable hinge structure when the air cleaner cover 30 is separated from the air cleaner body 10.

Figure 3:
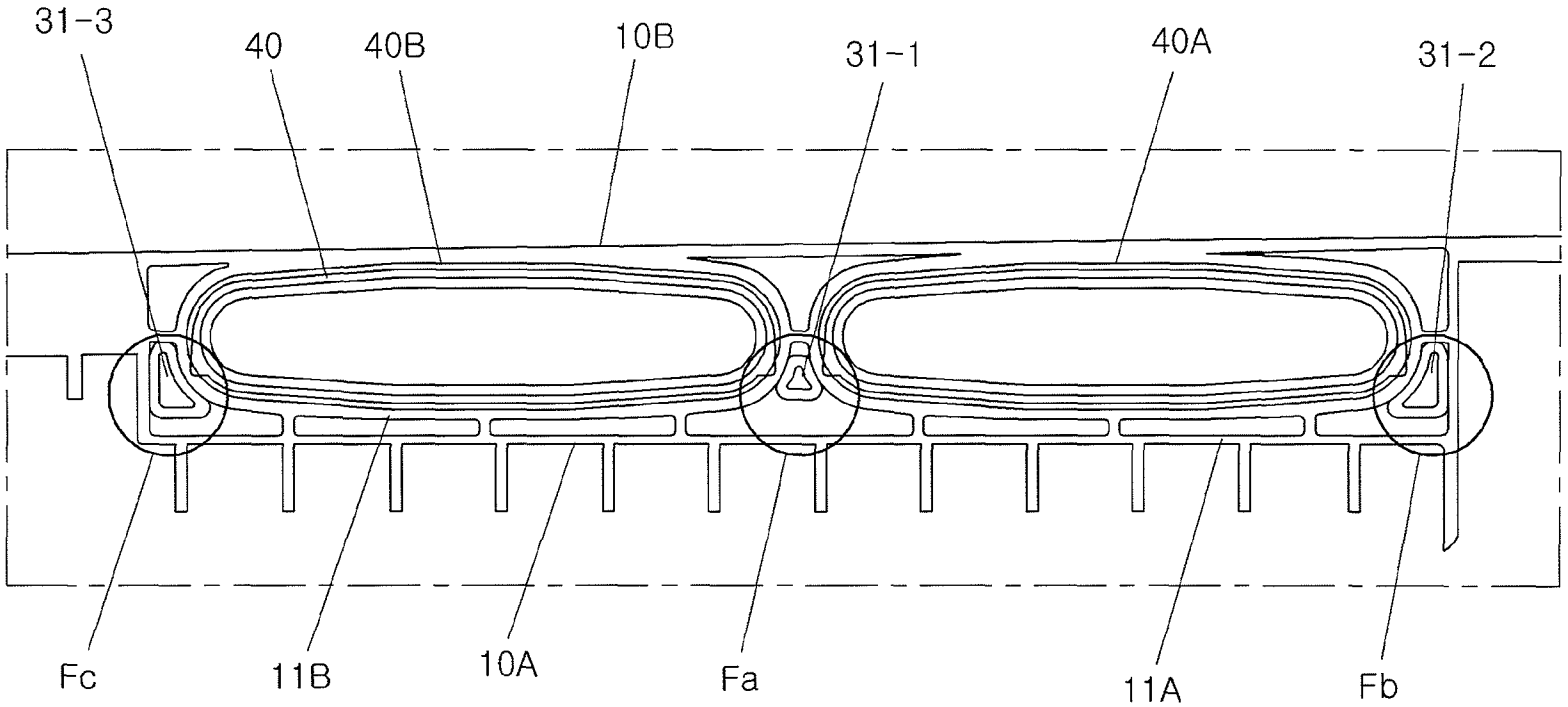
FIG. 3 is a view illustrating a detailed configuration of an insertion fixing structure of an air cleaner cover and an air cleaner body according to the embodiment of the present invention.

Meanwhile, FIG. 3 shows an example of an insertion fixing structure of the air cleaner cover 30 and the air cleaner body 10.

As shown in the drawing, when the first and second female passage bosses 11A and 11B are respectively fitted to the first and second male passage bosses 33A and 33B, fixing forces Fa, Fb, and Fc are defined by the first, second, and third fixtures 31-1, 31-2, and 31-3 protruding between the first and second male passage bosses 33A and 33B, thereby allowing the air cleaner cover 30 and the air cleaner body 10 to be coupled in an insertion manner.

Specifically, the first fixture 31-1 is fitted to a groove formed between the first and second female passage bosses 11A and 11B so that the fixing force Fa is defined, the second fixture 31-2 is fitted to a groove formed at one end of the first female passage boss 11A so that the fixing force Fb is defined, and the third fixture 31-3 is fitted to a groove formed at one end of the second female passage boss 11B so that the fixing force Fc is defined.

Therefore, the air cleaner cover 30 may be prevented from lifting due to ventilation resistance during the flow of air, by the fixing forces Fa, Fb, and Fc at three points of the air cleaner body 10.

Figure 4A:
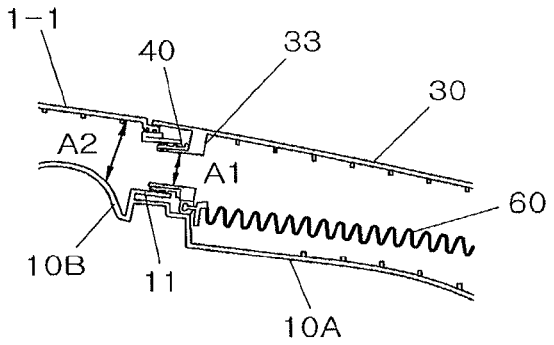
FIG. 4A, FIG. 4, and FIG. 4C are cross-sectional view illustrating a structure of an expansion pipe in which an air cleaner body in the exemplary insert type expansion pipe-integrated air cleaner according to the present invention may act as a surge tank.
Figure 4B:
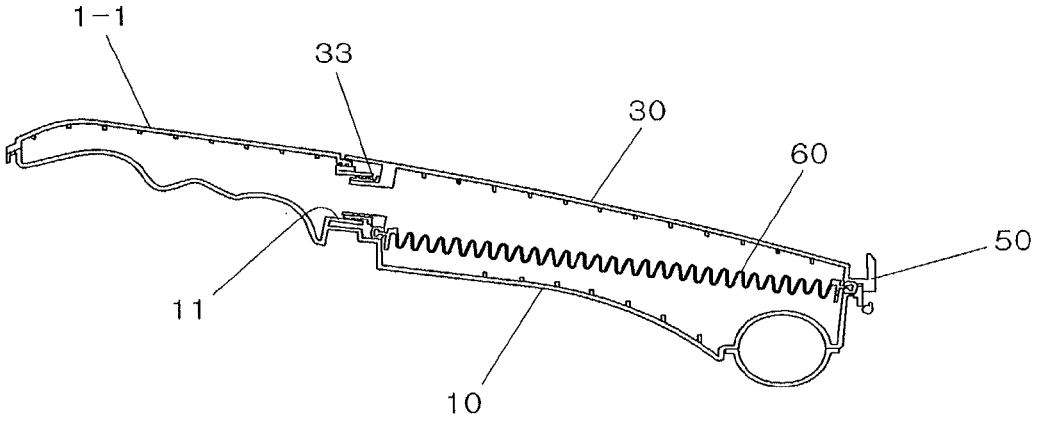
Figure 4C:
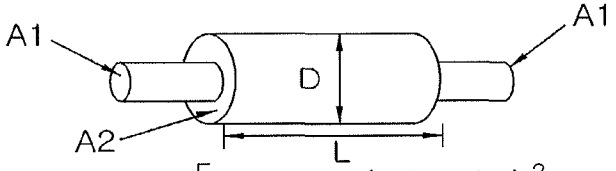

Meanwhile, FIG. 4A, FIG. 4B, and FIG. 4C show a structure of an expansion pipe in which the air cleaner body 10 may act as the surge tank.

As shown in the drawings, a cross-section of the air cleaner body 10 taken in a longitudinal direction thereof has a continuous longitudinal cross-sectional structure connected to the filter chamber 10A, the female passage boss 11, and the expansion pipe chamber 10B. A second cross-sectional area A2 of the expansion pipe chamber 10B is relatively greater than a first cross-sectional area A1 of the female passage boss 11. Therefore, a difference between the first and second cross-sectional areas A1 and A2 may allow the expansion pipe chamber 10B to act as the surge tank, as proved by equation illustrated in FIG. 4C.

Figure 5A:
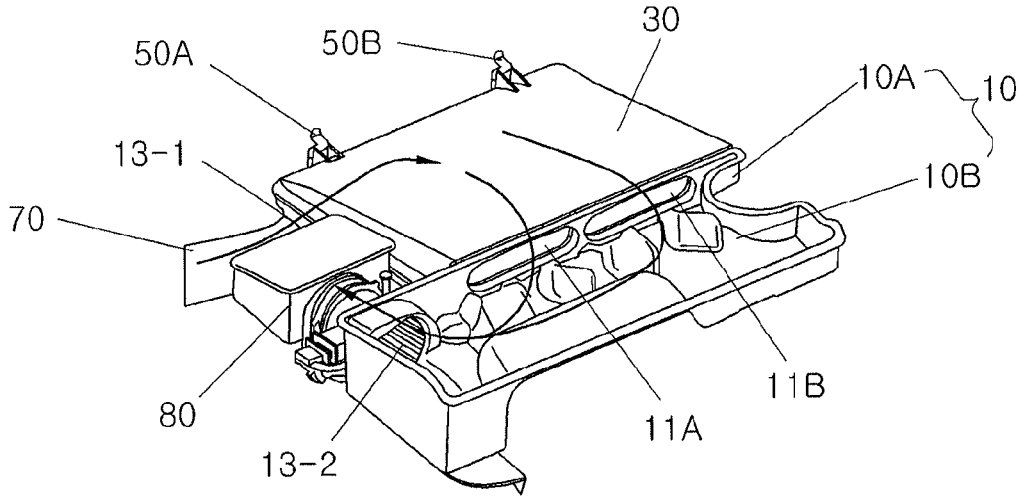
FIG. 5A and FIG. 5B are views illustrating an operation state and a performance chart of the exemplary insert type expansion pipe-integrated air cleaner according to the present invention.
Figure 5B:
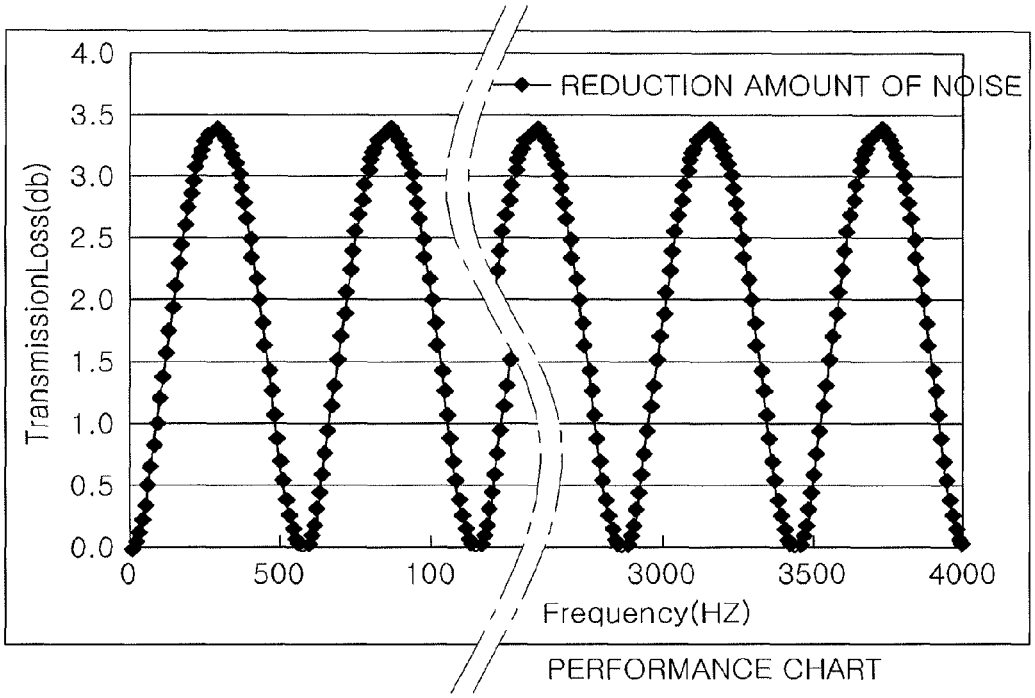

Such an operation results in a reduction amount of noise in a Transmission Loss (db)—Frequency (HZ) performance chart measured when air introduced from the intake duct 70 is discharged to the intake hose 80, as shown in FIG. 5A and FIG. 5B.

Figure 6:
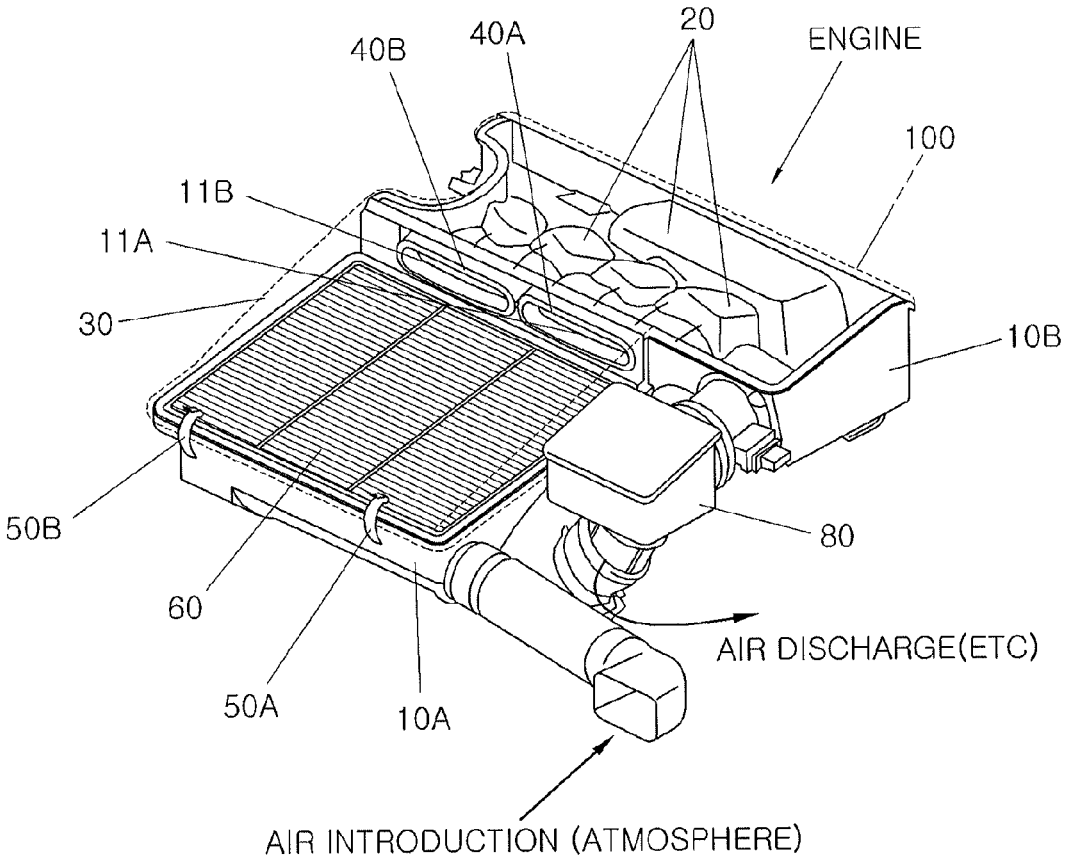
FIG. 6 is a view illustrating an example in which the exemplary insert type expansion pipe-integrated air cleaner according to the present invention is configured as a portion of an engine intake system using an engine cover.

Meanwhile, FIG. 6 shows an example in which the insert type expansion pipe-integrated air cleaner 1 is configured as a portion of the engine intake system using an engine cover.

As shown in the drawing, the air cleaner 1 may be simply configured as a portion of the engine intake system by removing the air cleaner cap 1-1 for covering the expansion pipe chamber 10B of the air cleaner body 10 from the outside and by covering the expansion pipe chamber 10B using an engine cover 100 instead of the air cleaner cap 1-1.

In this case, the intake duct 70 connected to the air inlet 13-1 of the air cleaner 1 is replaced with the air intake duct of the engine intake system for introducing air from the outside. In addition, the intake hose 80 connected to the air outlet 13-2 of the air cleaner 1 is replaced with the Electronic Throttle Control (ETC) connection hose connected to the ETC for controlling intake air supplied to the engine.

Therefore, the air cleaner 1 according to various embodiments may have expandability so as to be easily applied to engine intake systems of all vehicles.

As described above, the insert type expansion pipe-integrated air cleaner 1 according to various embodiments includes the air cleaner body 10 including the filter chamber 10A in which air is introduced from the outside, the filter chamber 10A having the chamber space provided with the filter 60, the chamber space being covered by the air cleaner cover 30, the expansion pipe chamber 10B connected to the filter chamber 10A such that introduced air is discharged from the expansion pipe chamber 10B to the outside, and the female passage boss 11 through which the introduced air passes from the filter chamber 10A to the expansion pipe chamber 10B by having the cross-sectional area A1 smaller than the cross-sectional area A2 of the expansion pipe chamber 10B, while dividing the filter chamber 10A and the expansion pipe chamber 10B. Consequently, the improvement in pressure absorption performance, the reduction in ventilation resistance, and the improvement in Noise, Vibration, and Harshness (NVH) of the intake system may be achieved. It may be possible to achieve reductions in the number of components and fastening processes by the fitting structure of the air cleaner cover 30 with the air cleaner body 10, compared to a clamp type air cleaner. Particularly, it may be possible to improve pressure absorption and performance of the intake system when the air cleaner is applied to the intake system of the vehicle.

In an air cleaner according to various embodiments of the present invention, an air cleaner body acts as a surge tank and an expansion pipe having a large space by an insert type coupling structure of the air cleaner body and an air cleaner cover, thereby enabling an improvement in pressure absorption performance and a reduction in ventilation resistance to be effectively achieved.

In addition, the air cleaner may achieve reductions in the number of components and fastening processes and high maintenance by integration of the air cleaner cover with air cleaner body using a hinge, compared to a clamp type air cleaner. Particularly, it may be possible to reduce costs and weight of the air cleaner because of no need for a structure of fixing a separate air cleaner filter, compared to a drawer type air cleaner.

In addition, the air cleaner may effectively improve high-frequency noise by a compression/sound absorption duct bonded to the air cleaner body.

In addition, the air cleaner is integrated with an engine cover and an engine intake system is composed of the integrated component, and thus it may be possible to effectively improve pressure absorption and NVH of the intake system by an increase in a transmission area. Particularly, since the integrated air cleaner and engine cover are mounted above an engine, an aesthetic appearance of an engine room may be significantly improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An insert type expansion pipe-integrated air cleaner comprising:

an air cleaner body including:

a filter chamber in which air is introduced from an outside, the filter chamber having a chamber space provided with a filter, the chamber space being covered by an air cleaner cover;

an expansion pipe chamber connected to the filter chamber such that the introduced air is discharged from the expansion pipe chamber to the outside; and a female passage boss through which the introduced air passes from the filter chamber to the expansion pipe chamber by having a cross-sectional area smaller than a cross-sectional area of the expansion pipe chamber while the female passage boss divides the filter chamber and the expansion pipe chamber, wherein the air cleaner cover is formed with a male passage boss protruding from the air cleaner cover such that the male passage boss is inserted into the female passage boss, and a sealing ring is fitted to the female passage boss.

2. The insert type expansion pipe-integrated air cleaner of claim 1, wherein the filter chamber is formed with an air inlet through which the air is introduced, the expansion pipe chamber is formed with an air outlet through which the air is discharged, and the air outlet is formed at a portion of the expansion pipe chamber deviated from the filter chamber.

3. The insert type expansion pipe-integrated air cleaner of claim 1, wherein the air cleaner cover includes fixtures protruding to a peripheral portion of the male passage boss, and the fixtures are fixedly fitted to a peripheral portion of the female passage boss.

4. The insert type expansion pipe-integrated air cleaner of claim 3, wherein the female passage boss includes first and second female passage bosses distinguished from each other, the male passage boss includes first and second male passage bosses distinguished from each other, and the fixtures include:

a first fixture fitted to a groove at an intermediate portion at which the first female passage boss comes into contact with the second female passage boss;

a second fixture fitted to a groove at a left portion of the first male passage boss; and a third fixture fitted to a groove at a right portion of the second male passage boss.

5. The insert type expansion pipe-integrated air cleaner of claim 4, wherein each of the first and second female passage bosses and the first and second male passage bosses forms an oval air passage hole.

6. The insert type expansion pipe-integrated air cleaner of claim 1, wherein the expansion pipe chamber is provided with a compression/sound absorption duct for reducing discharge noise due to a flow of the air discharged to the outside, and the compression/sound absorption duct protrudes from a bottom surface of the expansion pipe chamber.

7. The insert type expansion pipe-integrated air cleaner of claim 1, further comprising a hook coupling a portion of the air cleaner cover, which is not coupled to the female passage boss, to a portion of the filter chamber, wherein the hook acts as a hinge point of the air cleaner cover when the air cleaner cover is separated from the female passage boss.

8. The insert type expansion pipe-integrated air cleaner of claim 7, wherein the hook includes a hinge strap formed at a portion of the filter chamber and a hinge boss formed at the portion of the air cleaner cover.

9. The insert type expansion pipe-integrated air cleaner of claim 1, wherein the expansion pipe chamber is coupled to an air cleaner cap, and the air cleaner cap blocks a chamber space in the expansion pipe chamber from the outside, the introduced air being discharged from the chamber space to the outside.

* * * * *